United States Patent [19]

Chevrolet

[11] 3,942,202

[45] Mar. 9, 1976

[54] FLUID DISTRIBUTOR USABLE AS AIR-SUPPORT MATTRESS

[75] Inventor: Gerard Chevrolet, Damphreux, Berne, Switzerland

[73] Assignee: Roxer SA, Saignelegier, Switzerland

[22] Filed: Nov. 27, 1974

[21] Appl. No.: 527,811

[30] Foreign Application Priority Data

Dec. 19, 1973 Switzerland ..... 17835/73

[52] U.S. Cl. ..... 5/348 R; 5/347

[51] Int. Cl.[2] ..... A47C 27/08

[58] Field of Search ..... 5/347, 348 R, 349, 350

[56] References Cited

UNITED STATES PATENTS

| | | | |
|---|---|---|---|
| 452,234 | 5/1891 | Perry | 5/348 R X |
| 3,740,777 | 6/1973 | Dee | 5/348 R |

*Primary Examiner*—Casmir A. Nunberg
*Assistant Examiner*—Andrew M. Calvert
*Attorney, Agent, or Firm*—Karl F. Ross; Herbert Dubno

[57] ABSTRACT

An air-support mattress comprises an elastomeric plate having upper and lower faces flanking a central neutral surface. This plate is formed with a network of passages which lie between the lower face and the neutral plane and are adapted to be connected to a source of fluid under pressure. The plate is further formed with an array of vents each extending from the passage across the surface and terminating at respective mouths at the upper surface. A pair of lips in each of the vents meet tangentially between the neutral surface and the passage so as normally to block air flow through the vents. When the upper surface of the mattress is rendered concave, however, these lips pull apart so as to allow a stream of air to flow from the vents and exert a supporting force on a body part depressing the mattress.

3 Claims, 4 Drawing Figures

FLUID DISTRIBUTOR USABLE AS AIR-SUPPORT MATTRESS

FIELD OF THE INVENTION

The present invention relates to a fluid distributor. More particularly this invention concerns a mattress arrangement for supporting a person on a cushion of air.

BACKGROUND OF THE INVENTION

A fluid distributor is known comprising a surface having a plurality of orifices communicating with a distribution passage under the surface and each provided with a respective spring-loaded ball-type check valve. The top of the ball extends slightly above the surface of this distributor so that when depressed against the spring force fluid can flow out of the hole. Thus an object depressing one of the balls will be lifted at least partially by the current of air blowing out of the hole. Such an arrangement is extremely expensive. In addition in such an arrangement it is necessary that the upper surface be rather rigid so that it is impossible to use this type of arrangement as a mattress or the like.

Various devices have been suggested to support an invalid or other bed-ridden person on a cushion of air. It is thus known to provide a plurality of holes in the mattress which are connected to a source of air under pressure and whose output can be regulated either by vanes or barriers on the surface of mattress to allow for the shape of the body of the user. All such systems are relatively complicated and must be readjusted for each new user or each time the same user moves.

Another attempted solution is a type of air mattress which is formed of a succession of independently parallel tubes adapted to be inflated. The tubes are subdivided into two groups, every other tube belonging to the same group, so that it is possible to inflate every other tube, leaving the other tubes lying between them uninflated, and then to inflate the hitherto uninflated tubes and deflate the previously inflated tubes. In this manner pressure on the bed-ridden user is constantly changed so that the possibility of bed sores is greatly decreased. In addition such an arrangement is provided between the tubes with groups of throughgoing holes that allow air to blow up through the mattress and flow over the body of the user. Such a system is relatively complicated and does not truely support the body of the user on the cushion of air.

A system has been suggested for transporting objects along a corridor. The surface of the corridor or passage is made of an elastically deformable material which is longitudinally split so as to give access to a longitudinal air distribution canal of square section which extends under the transport surface. The two horizontal lips on each side of the split are adapted to separate when a weight is placed on the transport surface so as to allow a current of air to escape from the distribution passage and at least partially support the charge. Such a system has been suggested but in reality has never been highly effective as the relatively long slot opened by the weight of the charge allows an excess amount of air to escape from the distribution passage and therefore does not properly support the charge. In addition if sufficient pressure is provided in the distribution passage to support the charge the lips would have to be extremely rigid normally to lie shut so that the weight would have to be extremely large to open them.

OBJECTS OF THE INVENTION

It is therefore an object of the present invention to provide an improved fluid distributor.

Another object is the provision of an improved mattress arrangement which support the user principally on a cushion of air.

SUMMARY OF THE INVENTION

These objects are attained according to the present invention in a fluid distributor comprising an elastomeric plate having a pair of opposite parallel faces flanking a neutral plane. The plate is formed according to this invention with a pressurizable passage situated between one of the faces and a neutral surface and adapted to be connected to a source of fluid, with an array of vents each extending from this passage across the surface and terminating at respective mouths at the other end of the surfaces, and with a pair of lips in each of the vents and each of generally part-cylindrical shape. Each of the lips of each of the pairs normally presses tangentially against the other lip of the pair at a location between the neutral plane and the passage so as normally to block fluid flow through the respective vent. Thus according to the invention deformation of the plate rendering the other face concave pulls the lips apart and allows the fluid in the passage to flow out through the vents.

According to this invention the vents extend over between 55 and 65% of the overall thickness of the plate.

The distributor according to the present invention is extremely useful as a mattress. Wherever pressure is applied to the upper surface the corresponding vents are opened and the streams of air flowing from these vents take over at least part of the supporting function of the mattress. In this manner it is possible to support a bed-ridden user with extreme gentleness so as to almost completely to avoid the possibility of bed sores or the like. In addition the mattress in accordance to the present invention can be produced relatively inexpensively and requires little special hookup arrangements.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
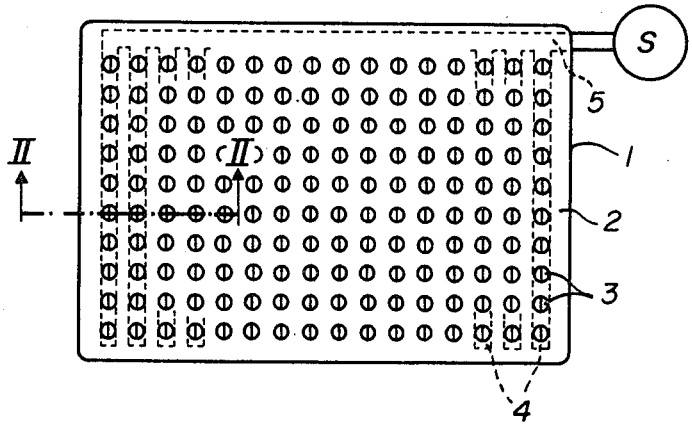
FIG. 1 is a top view of partly in diagrammatic form illustrating a distributor according to the present invention.
Figure 2:
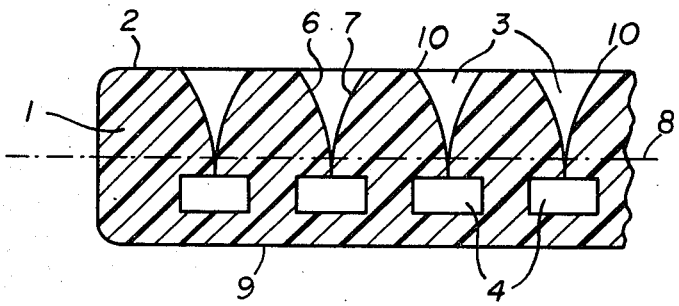
FIG. 2 is a section in enlarged scale taken along line II—II of FIG. 1.

As shown in FIGS. 1 and 2 the distributor according to the present invention comprises a synthetic-resin plate 1 having an upper face 2 and a lower face 9 equispaced from a central neutral surface or plane 8 indicated in dot-dash lines in FIG. 2. The plate 1 is formed between the neutral surface 8 and the lower face 9 with a plurality of parallel rectangular-section passages 4 which are blind at one end and terminate at the other end in a manifold passage 5 that is connected to a source S of compressed air. An array of vents 3 extending from the passages 4 and having circular mouths 10 at the face 2.

Figure 3:
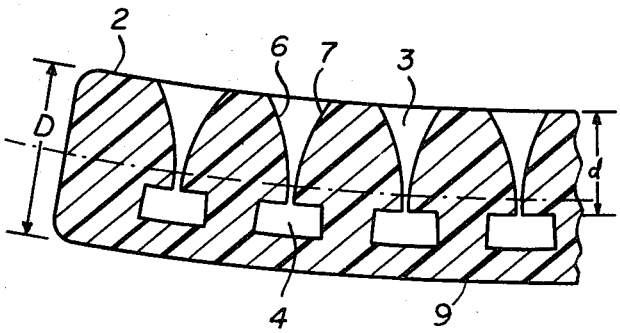
FIG. 3 is a view similar to FIG. 2 illustrating the distributor in deformed condition.
Figure 4:
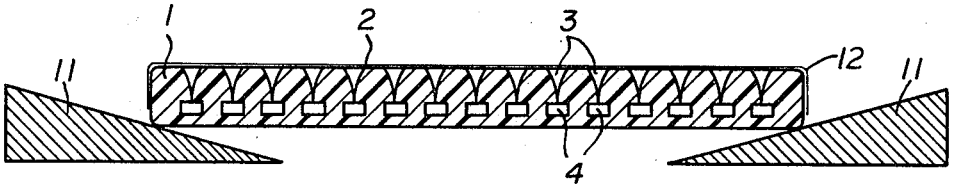
FIG. 4 is a side view illustrating usage of the distributor according to the present invention.

Each of these vents 3 has a pair of lips 6 and 7 which meet tangentially between the surface 8 and the passages 4 so that as shown in FIG. 2 when the plate 1 is flat the lips 6 and 7 block off the vents 3 and prevent air flow from the passages 4 out the mouths 10. When as shown in FIG. 3 the plate is deflected such that the surface 2 is concave, the lips 6 and 7 are pulled apart below the neutral surface 8 and the vents 3 are opened (by compression above the neutral plane, and tension thereblow) so that air flow out of the passages 4 from the mouths 10 is possible. In use the plate 1 is utilized as a mattress which is spanned between a pair of wedge cushions 11 as shown in FIG. 4.

A mattress according to the present invention was made of a synthetic-resin marketed under the trade name Silastic ERTV made by Dow-Corning and comprising a silicone two-part elastomer having a 30 to 35 durometer value. The mattress 1 had an overall thickness D equal to 15 mm and the distance *d* between the passages 4 and the surface 2 was equal to 9 mm or 0.600. In this manner the mattress is overall relatively rigid but has a local rigidity which is relatively low. Thus it is possible for this mattress 1 to conform relatively readily to the shape of a body lying thereon. The rigidity of the arrangement is shown by the inability of the plate 1 to be deflected sufficiently under the effective pressure of 30–50 mbar. If the deflectability is not sufficient the air flow from the mattress will be too weak.

A study of the support of different parts of the human body has revealed the necessary pressure to support a limb is between 50 and 30 mbar. The blood pressure however varies from 0 to 20 mbar in the extremities to 80–100 mbar near the heart. It is thus necessary that the pressure of support on the skin not be higher than that which is in the blood vessels thereunder so as to cut off circulation. It is therefore necessary to stay below the average value of 30–50 mbar.

The quantity of air necessary to support a member of the body is relatively low. In order to support an arm or a leg 50–100 l/min of air compressed at a pressure of 150 mbar is necessary. The result is that the speed of the air at the restriction formed by the lips 6 and 7 should not exceed 1 m/s. In this manner losses of pressure are relatively negligable. At the same time in order to obtain a sufficient air flow the angle of deflection should be of the order of 10° for the back region and of the order of 30° for a limb. This deflectability is obtained by use of the cushions 11 shown in FIG. 4 where a flow of 50–100 liters per minute is obtained. In use a sheet indicated at 12 overlays the plate 1 so as to avoid subjecting the skin of the user to a noisy and disagreeable vibration. The sheet 12 is very fine so as to eliminate these oscillations without however destroying the supporting abilities of the mattress 1.

I claim:

1. A fluid distributor comprising a solid elastomeric plate having a pair of opposite parallel faces flanking a neutral plane and formed with:

a pressurizable passage situated between one of said faces and said neutral plane and adapted to be connected to a source of fluid;

an array of vents each extending from said passage across said plane and terminating at respective mouths at the other of said faces; and a pair of lips in each of said vents, each of said lips being of generally part-cylindrical shape and normally bearing against the other of the lips of the respective pair tangentially between said neutral plane and said passage so as to normally prevent fluid flow from said passage out of said vent, whereby deformation of said plate rendering said other face concave pulls said lips apart and allows said fluid to flow from said passage out through said vents.

2. The distributor defined in claim 1 wherein said plate is made of a synthetic resin having a hardness between 30 and 35 durometer.

3. The distributor defined in claim 1 wherein said passage includes a plurality of parallel primary passages at said vents and a manifold passage opening into said primary passages.

* * * * *